United States Patent [19]

Coburn, Jr.

[11] Patent Number: 5,042,706

[45] Date of Patent: Aug. 27, 1991

[54] WEB WITH PAIRS OF HOLES IN ADDITION TO STANDARD FEED HOLES

[76] Inventor: Joseph W. Coburn, Jr., 953 Princewood Ave., Lakewood, N.J. 08701

[21] Appl. No.: 535,039

[22] Filed: Jun. 7, 1990

[51] Int. Cl.[5] ..... B65H 20/20; B32B 3/10

[52] U.S. Cl. ..... 226/76; 226/87; 428/131; 428/192

[58] Field of Search ..... 226/76, 87; 281/2; 282/11.5 A; 428/131, 192

[56] References Cited

U.S. PATENT DOCUMENTS

| | | | |
|---|---|---|---|
| 3,972,606 | 8/1976 | Stewart | 226/76 X |
| 4,834,276 | 5/1989 | Logan | 226/76 |
| 4,867,363 | 9/1989 | Wood et al. | 226/76 |
| 4,959,254 | 9/1990 | Coburn, Jr. | 226/87 X |

*Primary Examiner*—Daniel P. Stodola
*Assistant Examiner*—P. Bowen
*Attorney, Agent, or Firm*—R. Gale Rhodes, Jr.

[57] ABSTRACT

A web for being fed by a pair of sprockets, each sprocket provided with a plurality of standard feed pins and one or more pairs of additional pins with one additional pin of each pair of additional pins located on either side of one or more of the standard feed pins, the web having a pair of longitudinally extending side edge portions with each side edge portion provided with a plurality of standard feed holes for receiving the standard feed pins of one of the sprockets and each longitudinally extending side edge portion also provided with a plurality of pairs of additional holes equal in number to the plurality of standard feed holes, one additional hole of one pair of additional holes provided on either side of each of the standard feed holes to permit the pairs of additional holes to receive the one or more pairs of additional pins regardless of the circumferential location of the one or more pairs of additional pins on the sprockets.

4 Claims, 1 Drawing Sheet

10A
46a
42
46b
46a
42
46b
10
11
30
32b
32a
30a
20
30
14
30
30
34a
30b
34b
18
30
30
48a
48b
44
48a
44
48b
10B
38a
36
38b
36
36a
36
16
40a
36b
40b
36
10'
d2
d2
46a'
42
46b
32a
d1
14

WEB WITH PAIRS OF HOLES IN ADDITION TO STANDARD FEED HOLES

BACKGROUND OF THE INVENTION

This invention relates generally to a new and improved web for feeding into or through web handling machines such as sign makers, plotters, recorders and the like, wherein the web is fed longitudinally by the feed pins provided on a pair of rotating feed sprockets which feed pins cooperate with feed holes provided in the two longitudinal side edge portions of the web.

As known to the art, for various purposes, feed sprockets of web handling machines of the above-noted types, in addition to the standard feed pins, can have their feed sprockets provided with an extra pin or pairs of additional pins and such extra pin or pairs of additional pins can be located at different circumferential locations on the sprockets for different purposes.

An example of feed sprockets provided with such extra or pairs of additional pins, and a web for use therewith provided with extra pairs of additional holes, are disclosed in U.S. Pat. No. 4,834,276 patented May 30, 1989 entitled WEB LOADING AND FEEDING SYSTEM, RELATED WEB CONSTRUCTION AND METHOD AND APPARATUS FOR MAKING WEB, David J. Logan inventor and assigned to Gerber Scientific Products, Inc. (the Logan Patent). The teaching of the Logan Patent, inter alia, is that the extra or pairs of additional pins provided on the sprockets visually distinguish corresponding pairs of standard feed pins and that the extra or pairs of additional holes provided in the web visually distinguish corresponding pairs of standard feed holes on the web and that these visually distinguished pairs of corresponding standard feed pins and pairs of corresponding standard feed holes permit the ready alignment of the web with the sprockets and prevent damage or ruin of the web due to web-sprocket misalignment as the web is advanced into the web handling machine; the web 12 shown in FIG. 10 and described at column 7, lines 38, et seq. of the Logan patent, and in particular note the additional pair of holes 54 and 90 provided on either side of standard feed hole 44, the additional pair of holes 56 and 92 provided on either side of the standard feed hole 48, and the pairs of additional pins (not shown but described in the specification where noted) mounted on the associated sprockets. It is stated in the Logan Patent that this misalignment problem is particularly prevalent when the web is very wide, and it is difficult to determine by the eye which sprocket pins correspond with one another and which feed holes on the opposite sides of the web correspond with one another. The Logan Patent includes claims covering a web loading and feeding system wherein the included sprockets are provided with visually distinguishing means, e.g. an extra pin or pairs of additional pines in addition to the standard feed pins, and claims a web wherein the two longitudinal s de edge portions of the web are provided with visually distinguished means, e.g. an extra hole or pairs of additional holes in addition to the standard feed holes. There are many web handling machines in the field covered by the web handling and feeding system claims of the Logan Patent and heretofore only webs covered by the web claims of the Logan Patent can be used on such web handling and feeding machines and others without permission to manufacture and sell webs covered by such web claims are precluded from making and selling webs for use on such web handling and feeding systems.

The inventor of the present web invention has found such stated web-sprocket misalignment is not typically a problem because the typical web used on such web handling machines is about 15 inches wide and an opertor generally has no problem in correctly visually aligning the correct web feed holes with the correct sprocket feed pins.

Accordingly, to promote commerce, there exists a need in the art for a new and improved web which may be used on web handling and feeding systems covered by the claims of the Logan Patent but which webs are not covered by the web claims of such Patent.

SUMMARY OF THE INVENTION

The object of the present invention is to satisfy the foregoing need in the web feeding art.

A web satisfying such need and embodying the present invention may have its longitudinally extending side edge portions provided with a plurality of standard feed holes spaced from each other for receiving standard feed pins provided on feed sprockets and wherein each standard feed hole is provided on either side thereof with one additional hole of a pair of additional holes and which pairs of additional holes receive any pairs of additional pins provided in the sprockets regardless of their circumferential location on the sprockets.

DESCRIPTION OF THE PREFERRED EMBODIMENT

Figures 1, 2:
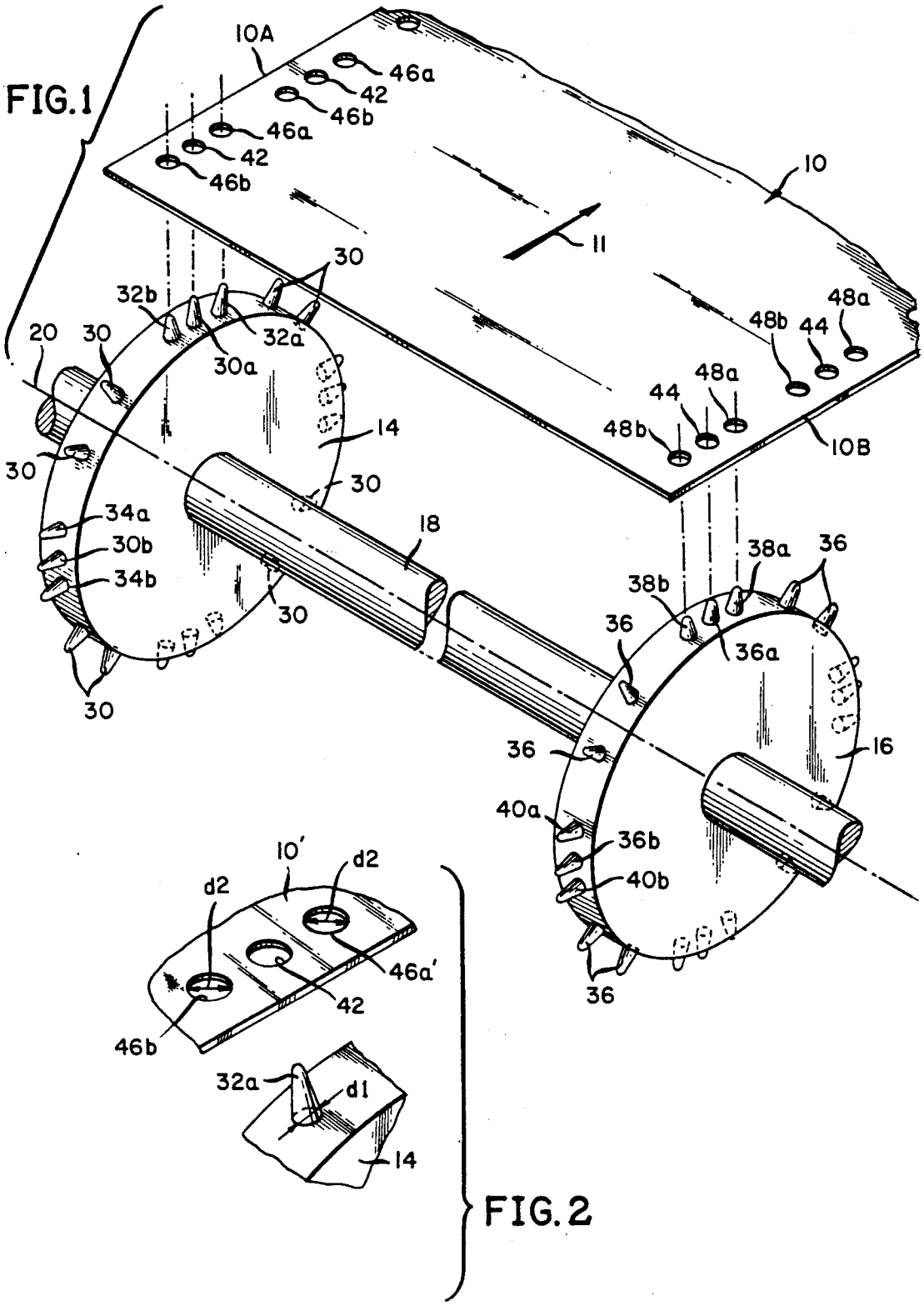
FIG. 1 is a fragmentary perspective view showing the relationship between the standard and pairs of additional pins extending radially outwardly circumferentially of drive sprockets as taught by the above-mentioned Logan Patent and the standard feed holes and pairs of additional holes provided along the longitudinally extending side edge portions of a web embodying the present invention.
FIG. 2 is a fragmentary view, partially in perspective, showing the relationship between the maximum diameter of a representative additional pin provided on a drive sprocket and the diameter of a pair of additional holes provided along a longitudinal side edge portion of an alternate embodiment of a web of the present invention.

Referring now to FIG. 1, there is illustrated a web identified by general numerical designation 10 embodying the present invention and a pair of feed sprockets 14 and 16 mounted for rotation on a common shaft 18 having an axis 20 and which feed sprockets may be the feed sprockets described at column 7, line 38 et seq., of the Logan Patent for feeding the web 10 shown in FIG. 10 of such Patent. Accordingly, sprocket 14 is provided with a plurality of radially outwardly extending standard feed pins 30 and certain, not all, standard feed pins, e.g. standard feed pins 30*a* and 30*b* are provided with pairs of radially outwardly extending additional pins 32*a* and 32*b* and 34*a* and 34*b*, respectively; in particular it will be noted that standard feed pins 30 between standard feed pins 30*a* and 30*b* are not provided with such pairs of additional pins. Similarly, sprocket 16 is provided with a plurality of radially outwardly extending standard feed pins 36 and certain, not all, e.g. standard feed pins 36*a* and 36*b* are provided, respectively, with pairs of additional radially outwardly extending pins 38*a* and 38*b* and 40*a* and 40*b*; particularly it will be noted that the standard feed pins 36 between standard feed pins 36*a* and 36*b* are not provided with pairs of additional pins. As taught above with respect to the Logan Patent, pairs of additional pins 32*a* and 32*b* and 38*a* and 38*b* visually distinguish standard feed pins 30*a* and 36*a* and indicate that standard feed pins 30*a* and 36*a* are aligned, i.e., lie in a common plane (not shown) extending through the sprocket axis 18.

Referring now particularly to web 10 embodying the present invention, FIG. 1, it will be understood that web 10 is provided with two longitudinally extending side edge portions indicated by general numerical designations 10A and 10B.

Side edge portion 10A is provided with a plurality of standard feed holes 42 for receiving the standard feed pins 30 provided on the sprocket 14 and the side edge portion 10B of the web 10 is provided with a plurality of standard feed holes 44 for receiving the standard feed pins 36 provided on the sprocket 16 to feed the web 10 longitudinally in the direction of the arrow 11 upon rotation of the sprockets 14 and 16.

In addition, side edge portion 10A is also provided with a plurality of pairs of additional holes 46*a* and 46*b* with such pairs of additional holes being equal in number to the standard feed holes 42 and wherein one additional hole of each pair of additional holes 42*a* and 42*b* is located on either side of each or every standard feed hole 42. Similarly, side edge portion 10B of the web 10 is provided with a plurality of pairs of additional holes 48*a* and 48*b* with such pairs of additional holes 48*a* and 48*b* equal in number to the standard feed holes 44 and wherein one additional hole of each pair of additional holes 48*a* and 48*b* is located on either side of each and every standard feed hole 44.

Accordingly, and referring again to FIG. 1, it will be understood in accordance with the teachings of the present invention that upon the standard feed pins 30 provided on the sprocket 16 and the standard feed pins 36 provided on the sprocket 16 being received, respectively, with the standard feed holes 42 provided in the longitudinally extending side edge portion 10A and the standard feed holes 44 provided in the longitudinally extending side edge portion 10B of the web 10, and upon the sprockets 14 and 16 being rotated, the web 10 will be fed longitudinally in the direction of the arrow 11. And, in accordance with the particular teaching of the present invention, it will be understood that the pairs of additional holes 46*a* and 46*b* provided in the side edge portion 10A of the web 10 and the pairs of additional holes 48*a* and 48*b* provided in the longitudinally extending side edge portion 10B of the web 10 will respectively receive, for example, the pairs of additional pins 32*a* and 32*b* and 36*a* and 36*b* provided on the sprocket 14 in association with the standard feed pins 30*a* and 30*b* and pairs of additional pins 36*a* and 36*b* and 40*a* and 40*b* provided on the sprocket 16 in association with the standard feed pins 36*a* and 40*a*. Still further it will be understood that since each and every standard feed hole 42 and 44 provided in the longitudinally extending edge portions 10A and 10B of the web 10 is provided, respectively, with a pair of additional holes 46*a* and 46*b* and 48*a* and 48*b*, such pairs of additional holes will receive pairs of additional pins provided on the sprockets 14 and 16 regardless of the location or locations of such pairs of additional pins circumferentially of the sprockets.

Referring now to FIG. 2 and the alternate embodiment web 10′ of the present invention, shown partially, it will be understood that in accordance with the further teachings of the present invention to facilitate receipt of the pairs of additional pins by the pairs of additional holes, such as representative pairs of additional holes 46*a*′ and 46*b*′, the diameters d2 of the pair of additional holes 46*a*′ and 46*b*′ are larger than the maximum diameter dl of a representative conical additional pin 32*a* provided on the sprocket 14, and thus the receipt of the pairs of additional pins by the pairs of additional holes is facilitated.

It will be understood that the standard feed pins 30 provided on sprocket 14 and standard feed pins 36 provided on sprocket 16 may be respectively spaced uniformly from each other circumferentially of the sprockets or the standard feed pins may be spaced non-uniformly from each other circumferentially of the sprockets, that the pairs of additional pins 32*a* and 32*b* and 38*a* and 38*b* provided respectively on the sprockets 14 and 16 may be spaced uniformly from their associated standard feed pins or may be spaced non-uniformly from their associated standard feed pins, and that in such event the spacing of the standard feed holes 42 and 44 longitudinally from each other along the respective side edge portions 10A and 10B of the web 10 will be correspondingly uniform or non-uniform and that the spacing between the pairs of additional holes 32*a* and 32*b* and 38*a* and 38*b* will be correspondingly uniform or non-uniform with respect to their associated standard feed holes in order that the feed holes and pairs of additional holes of the web 10 of the present invention will receive the standard feed pins and pairs of additional pins provided on the sprockets 14 and 16.

It will be understood that many variations and modifications of the present invention may be made without departing from the spirit and the scope thereof.

WHAT IS CLAIMED IS:

1. A web for feeding on a pair of feed sprockets rotatable about a common axis, each sprocket provided with a plurality of radially outwardly extending standard feed pins spaced from each other circumferentially of said sprocket, each standard feed pin on each sprocket associated with a standard feed pin on the other sprocket and associated standard feed pins lying in substantially the same plane containing said common axis, each of said sprockets provided with one or more pairs of additional pins extending radially outwardly therefrom with one or more of said standard feed pins on each sprocket having one additional pin of one of said pairs of additional pins located on either side thereof, comprising:

a longitudinally extending web provided with two longitudinally extending side edge portions each provided with a plurality of standard feed holes spaced from each other longitudinally of said web, the spacing of said standard feed holes corresponding to the spacing of said standard feed pins and said standard feed holes for receiving said standard feed pins to feed said web longitudinally upon rotation of said sprockets; and each of said side edge portions also provided with a plurality of pairs of additional holes equal in number to said standard feed holes, each standard feed hole having one additional hole of one of said pairs of additional holes located on either side thereof and each adjacent pair of standard feed holes having two of said additional holes therebetween, the spacing between said pairs of additional holes being less than the spacing between adjacent pairs of standard feed holes and during feeding of said web by said sprockets said pairs of additional holes for receiving said pairs of additional pins regardless of the location of said pairs of additional pins on said sprockets.

2. The web according to claim 1 wherein said standard feed holes are spaced uniformly from each other circumferentially of said sprocket and wherein said standard feed holes are spaced uniformly from each other longitudinally of said web.

3. The web according to claim 1 wherein said standard feed pins are spaced non-uniformly from each other circumferentially of said sprocket and wherein said standard feed holes are correspondingly spaced non-uniformly from each other longitudinally of said web.

4. The web according to claim 1 wherein said additional pins are conical and have a maximum transverse diameter and wherein said additional holes are circular and have a diameter larger than the maximum diameter of said additional pins to facilitate receipt of said additional pins by said additional holes.

* * * * *